United States Patent [19]

Garrison

[11] 4,266,715

[45] May 12, 1981

[54] CARTON

[75] Inventor: Earl G. Garrison, Fullerton, Calif.

[73] Assignee: Thacker Container Company, Santa Fe Springs, Calif.

[21] Appl. No.: 54,202

[22] Filed: Jul. 2, 1979

[51] Int. Cl.[3] ..... B65D 5/06; B65D 85/30

[52] U.S. Cl. ..... 229/37 E

[58] Field of Search ..... 229/37 E

[56] References Cited

U.S. PATENT DOCUMENTS

| | | | |
|---|---|---|---|
| 2,043,483 | 6/1936 | Lynch | 229/37 E X |
| 2,865,553 | 12/1958 | Wasyluka | 229/37 E |
| 3,660,116 | 5/1972 | Clark | 229/37 E X |
| 3,744,699 | 7/1973 | Burgess | 229/37 E X |
| 3,777,969 | 12/1973 | Nurre | 229/37 E |

FOREIGN PATENT DOCUMENTS

| | | | |
|---|---|---|---|
| 709720 | 5/1965 | Canada | 229/37 E |
| 1501894 | 10/1967 | France | 229/37 E |
| 1542490 | 9/1968 | France | 229/37 E |
| 631607 | 1/1962 | Italy | 229/37 E |

*Primary Examiner*—Davis T. Moorhead

*Attorney, Agent, or Firm*—William W. Glenny

[57] ABSTRACT

A carton formed of a single blank of cardboard or the like cut and scored to form four wall panels and an attachment flap, each wall panel having foldably attached thereto a flap comprising a plurality of rectangular foldable flap sections. The flaps attached to an opposing pair of wall panels are foldable to form a pair of spaced flap assemblies constituting beams for supporting projecting members of filing binders stored in the carton. Hand openings are formed in that pair of wall panels immediately under the beams. The flaps attached to the other pair of opposed wall panels are foldable so that notches formed therein create shoulders for underlying end portions of the beams.

8 Claims, 9 Drawing Figures

Fig. 6.
Fig. 5.
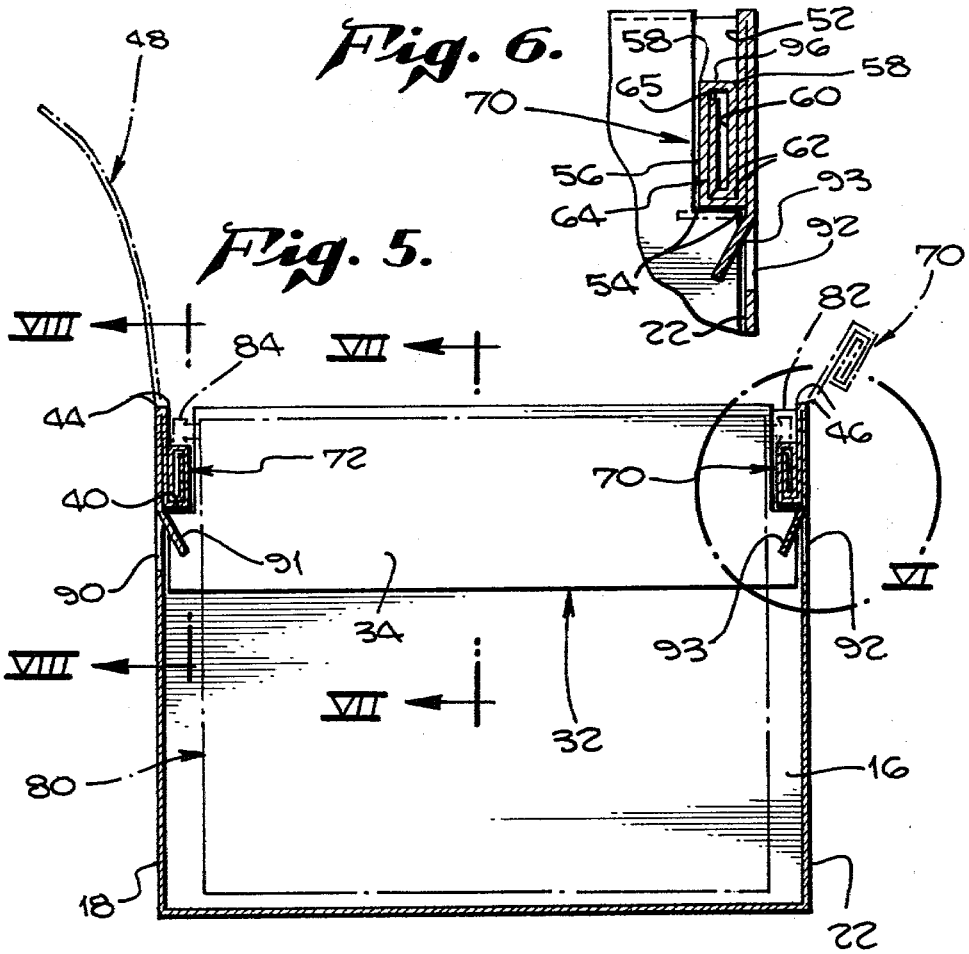
Fig. 7.
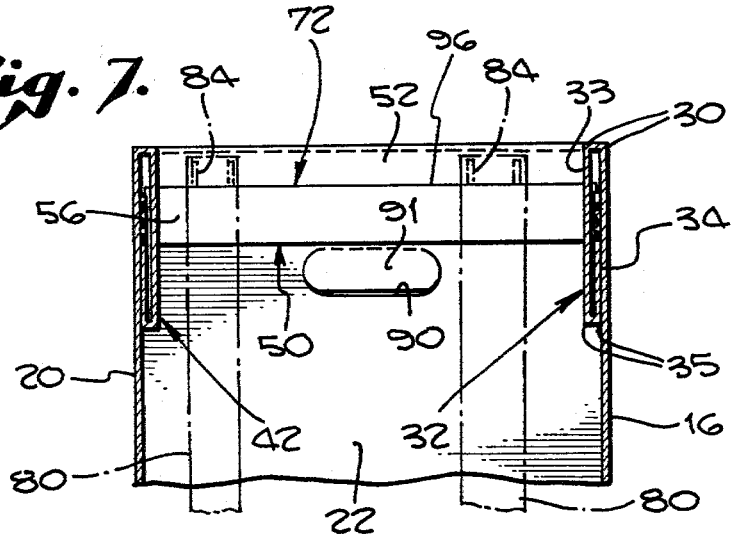

CARTON

BACKGROUND AND SUMMARY OF THE INVENTION

This invention relates generally to a container made of stiff foldable sheet material such as cardboard, and more particularly to such a container in the form of an open-topped carton of generally rectangular shape and including structural features comprising spaced internal ledges on opposed parallel end walls, the ledges serving as support members for items to be stored in the container.

The present container may be formed from a single sheet of cardboard, cut and scored by known processes to form front and rear side walls and left and right end walls and a sealing tab, together with tabs and flaps specially formed and cut to form structural beam members on opposed end walls and beam-reinforcing members on front and rear side walls. Each of the opposed end walls has formed therein an opening for receiving the four fingers of one of the user's hands for lifting the carton. These hand holes are formed by cutting tabs and folding the tabs inwardly through 90° so that the tabs underlie the beam members, which themselves serve as the ledges above mentioned for supporting projecting end members of material to be stored such as binders for containing files of paper records.

It is accordingly the principal object of this invention to provide a novel carton formed of cardboard or similar material. Additional objects are to provide such a carton which may be readily assembled by hand; to provide such a carton having integrally formed flaps foldable to form reinforcing beams or internal support ledges for supporting material to be stored in the carton; to provide such a carton having additional internal reinforcing members for strengthening said beams; and for other objects as will be understood from a reading of the following description, taken in connection with the accompanying drawings.

BRIEF DESCRIPTION OF THE DRAWINGS

FIG. 5 is a longitudinal sectional view of the carton taken on arrows V—V of FIG. 4; the end flaps are shown in dotted outline, one before being folded to form its transverse beam, the other after forming its transverse beam but before the beam has been swung into its operative position shown in solid lines. Also shown in dotted outline is a typical hanging binder of the type for which the present carton is particularly applicable.

FIG. 6 is a fragmentary sectional view on an enlarged scale, of the parts within dotted circle VI of FIG. 5.

FIG. 7 is a sectional view taken on arrows VII—VII of FIG. 5, showing in dotted outline the upper portions of two hanging binders in the carton.

DETAILED DESCRIPTION

Figure 1:
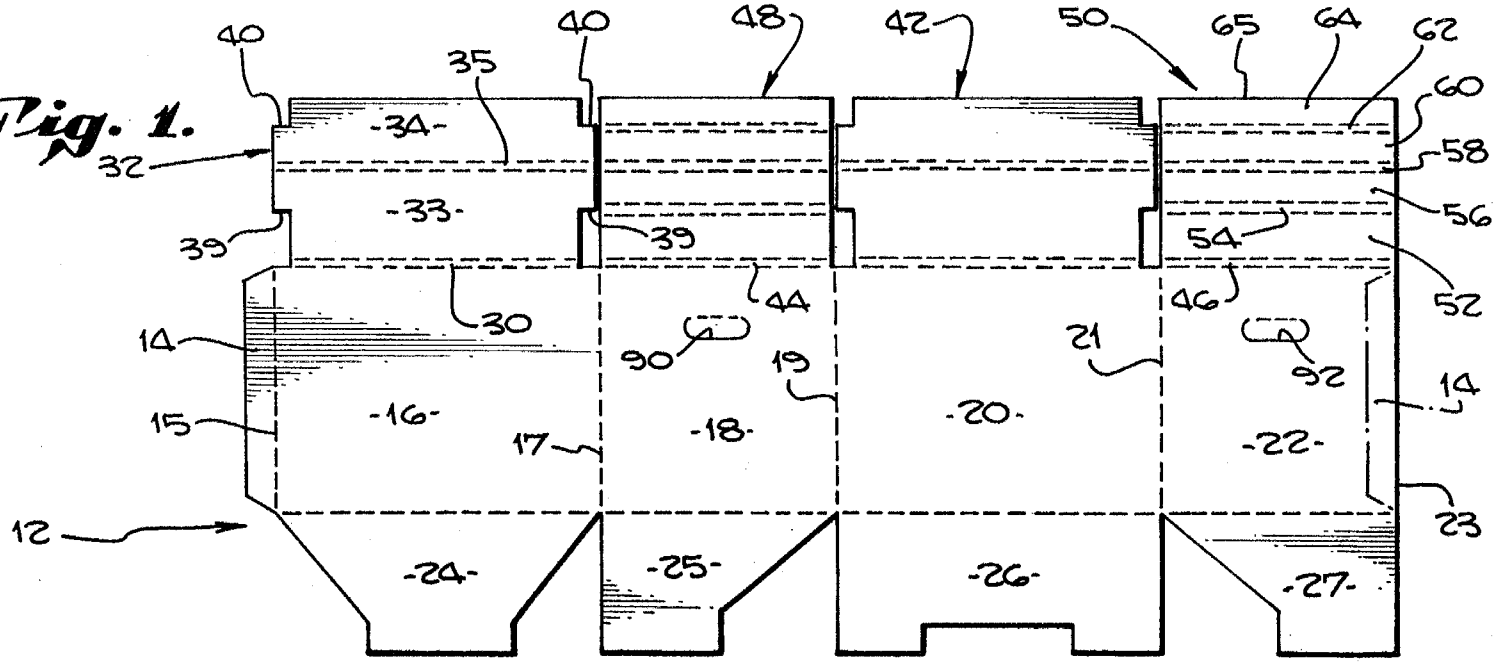
FIG. 1 is a plan view of a blank of cardboard or the like from which the carton of the present invention may be formed.
Figure 8:
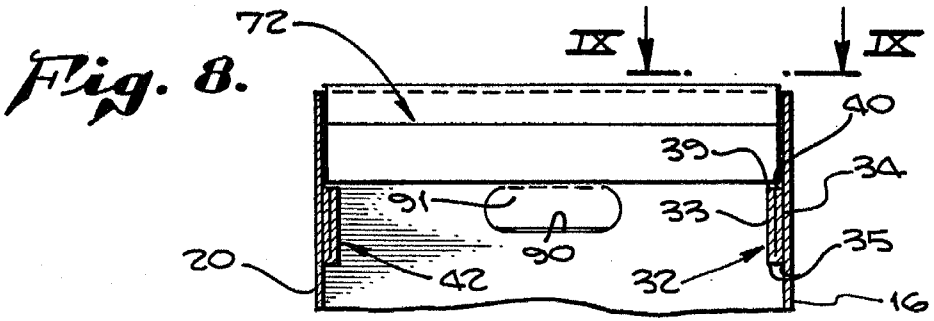
FIG. 8 is a sectional view taken on arrows VIII'VIII of FIG. 5.
Figure 9:
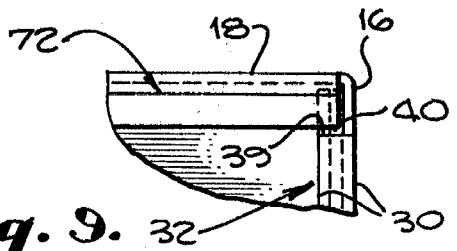
FIG. 9 is a fragmentary view taken on arrows IX—IX of FIG. 8, showing details of an upper corner construction.

In FIG. 1 is shown a blank of cardboard or equivalent from which the present carton can be formed, the blank being indicated generally at 12 and including a sealing tab 14 joined along fold line 15 to an edge of rear side wall panel 16, in turn joined along fold line 17 to left end wall panel 18 and, successively, fold line 19, front side wall panel 20, fold line 21 and right end wall panel 22 having an outer edge 23. Along the lower edges of these panels is a series of flaps 24, 25, 26 and 27 each foldably attached to the respective panels mentioned above, and adapted to form the bottom closure of the carton, if such a closure is used. Flaps 24–27 are conventional and form no part of the present invention. When used, flap 26 is first folded inwardly 90°, then flaps 25 and 27 are similarly folded, and finally flap 24 is similarly folded with its outer tab 28 tucked in above flap 26. However, as stated above, any other bottom construction could be used, or the bottom-forming flaps could be omitted, and hence they will not be shown or described further herein.

In manufacture, after the blank 12 has been made by conventional cutting and scoring operations, the left portion of the blank is folded 180° on fold line 19, and sealing tab 14 is folded 180° on its fold line 15, and is then firmly attached to the marginal portion of panel 22 adjacent to outer edge 23, preferably on what will be the inner face of panel 22. Typically the attachment will be accomplished by a suitable adhesive, and the tab 14 will then be in the position shown in dotted outline in FIG. 1. It may be noted that, once the tab 14 has been attached to panel 22, the entire blank may be stored flat until need for assembly into carton form arises, to be now described with reference to FIGS. 2, 3 and 4.

Figure 2:
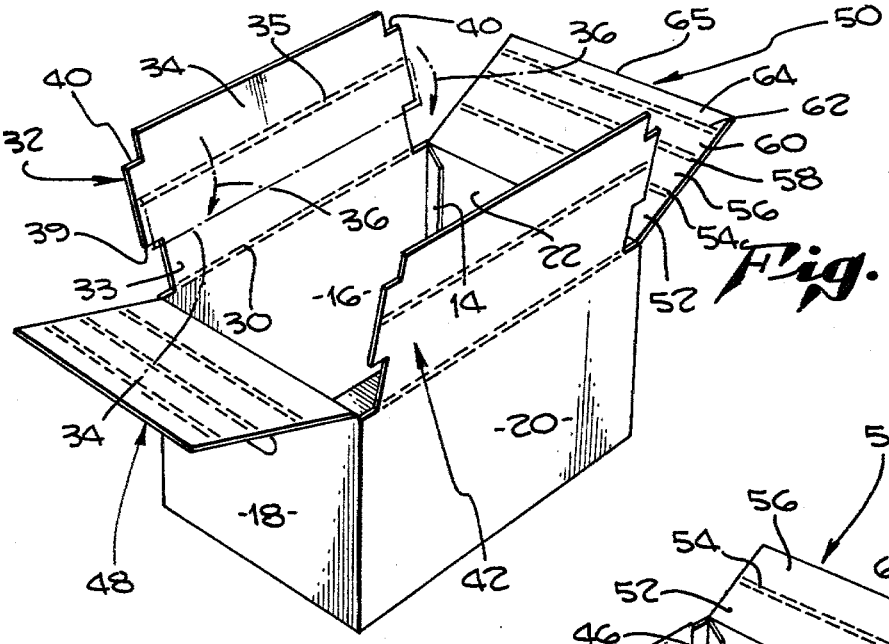
FIGS. 2, 3 and 4 are perspective views showing successive steps in the assembly of the upper side and end flaps into their positions in the completed carton.

Rear side wall panel 16 has attached thereto along upper double score lines 30 a flap indicated generally at 32 and including major and minor flap sections 33 and 34 foldably connected along double score lines 35. After unfolding the carton to its shape as seen in FIG. 2, the first step in assembly is to fold minor flap section 34 forwardly about score lines 35 as indicted by arrows 36 through an angle of 180°, to its position seen in dotted outline in FIG. 2, immediately adjacent to major flap section 33. The end walls of each of flap sections 33 and 34 are notched to form shoulders 39 and 40. The final step of assembly of flap 32 is to rotate flap section 33 forwardly and downwardly to its position seen in FIG. 3, with flap section 34 snugly held between flap section 33 and wall panel 16, and with shoulders 39 and 40 in alignment.

Front side wall panel 20 has connected thereto a flap indicated generally at 42, which is identical to flap 32, and which is assembled into the body of the carton in the same way as just described for flap 32. End wall panels 18 and 22 have foldably attached thereto along double score lines 44 and 46 flaps indicated generally at 48 and 50 respectively, which are folded and assembled in the same manner, to be now described with reference to flap 50. Thus flap 50 includes a major flap section 52, bounded inwardly and outwardly by double score lines 46 and 54, minor flap section 56 bounded outwardly by double score lines 58, minor flap section 60 bounded outwardly by double score lines 62, and minor flap section 64 bounded outwardly by edge 65. The first minor flap section 56 is substantially narrower than the adjacent major flap section 52, and the widths of the other minor flap sections 60 and 64 are progressively slightly smaller than the width of flap section 56.

Figure 3:
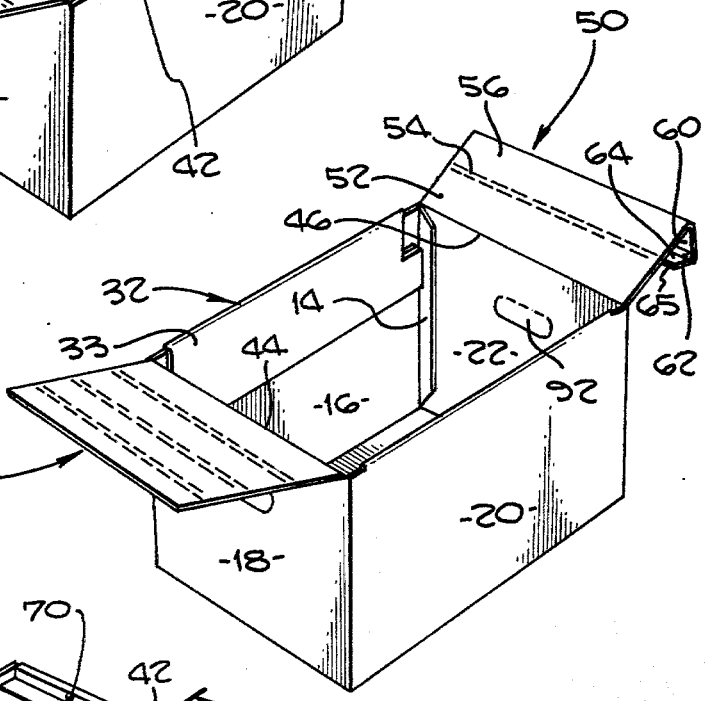

Starting with the outer flap section 64, the user folds it outwardly or clockwise as seen in FIG. 3, and continues folding successive flap sections outwardly along double fold lines 62, 58 and 54 to form a compact folded assembly indicated generally at 70 in FIG. 5, and then folds the assembly inwardly or counterclockwise about double fold lines 46 from the dotted line position of FIG. 5 into the solid line position there shown. As will be understood, the latter part of the final folding is accomplished by slightly springing the side walls 16 and 20 outwardly to permit the flap assembly 70 to slide by the folded flap sections 33 and 34 of flap 32 and the corresponding flap sections of flap 42.

Figure 4:
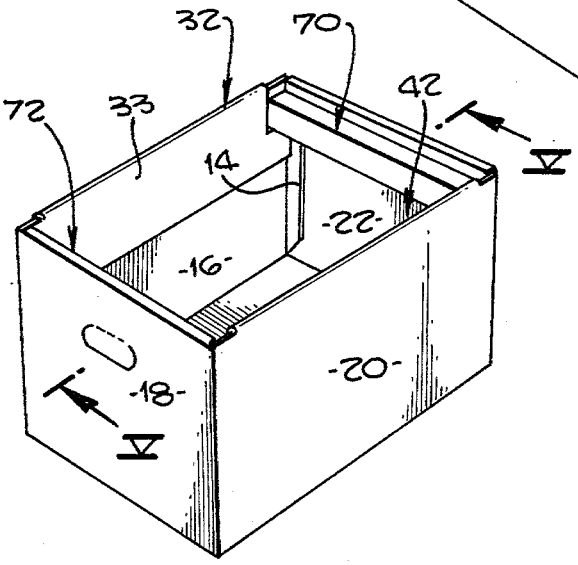

Flap 48 is similarly folded and assembled, thus forming the finished carton as seen in FIG. 4.

Each of the folded flap assemblies 70 of flap 50 and the corresponding assembly 72 of flap 48 constitutes a beam extending transversely between the side walls of the carton for supporting outwardly projecting extensions of the binders in which records such as computer printouts are filed. One such binder is shown in phantom in FIG. 5, indicated generally at 80 and provided with the extensions just mentioned 82 and 84 supported respectively by beams 70 and 72, whose upper surfaces constitute ledges for such support.

The weight carried by beams 70 and 72 is distributed to a substantial degree to side walls 16 and 20 by reason of the fact that end portions of the beams rest upon the upwardly directed shoulders 39 and 40 of flap 32 and the corresponding shoulders of flap 42 as seen, for example, in the upper corner area of FIG. 4 and elsewhere in the drawings.

In each end wall 18 and 22 there is formed a hand opening 90 and 92 respectively whose flaps 91 and 93, as best seen in FIG. 5, fold inwardly to underlie the respective beams 72 and 70 when the user inserts his fingers to lift the carton.

The rectangular side wall panels 16 and 20 and their associated flaps 32 and 42 are congruent to one another, as are end wall panels 18 and 22 and their associated flaps 48 and 50. The score or fold lines are referred to herein as double in view of the fact that each individual score line is intended to permit folding through only 90°. Thus, as best seen in the fragmentary view FIG. 6, the double fold lines 58 define therebetween a narrow rectangular connector strip 96, which constitutes the upper ledge of beam 70 on which the binder extension 82 is supported.

Minor modifications and changes from the illustrative embodiment of the invention herein described and illustrated are intended to be embraced within the scope of the appended claims.

What is claimed is:

1. A carton of sheet material comprising a pair of opposed rectangular front and rear side walls and a pair of opposed rectangular left and right end walls and sealing tab means extending from an edge of one of said walls and adapted to be attached to the distant edge of another of said walls, said walls and tab being formed from a single blank of sheet material joined to one another along edges formed by scored fold lines, characterized in that:

said pair of end walls has foldably attached to end wall edges perpendicular to said fold line edges a pair of end flaps, each flap comprising a plurality of rectangular flap sections alternating with and foldably connected to relatively thin rectangular connector strips defined by scored fold lines, the flap sections including a major flap section foldably attached to an end wall edge and at least two minor flap sections substantially narrower in a direction perpendicular to said end wall edge than the major flap section, the flap sections of each flap being foldable into parallel relation to form a transverse beam extending between said side walls, said beam having an upwardly directed ledge formed by one of said connector strips for supporting a load, and each major flap section being in juxtaposed relation with the inner face of its end wall.

2. The invention as defined in claim 1 wherein said pair of side walls has foldably attached to side wall edges a pair of side flaps, each side flap comprising a plurality of side flap sections foldably connected by thin rectangular connector strips defined by scored fold lines, each side flap having formed therein a pair of spaced upwardly directed shoulders for supportingly contacting end portions of the lower faces of said beams.

3. The invention as defined in claim 1 wherein each of said end walls has formed therein a hand opening immediately below its beam.

4. A carton formed from a blank of foldable material having vertical side and end walls in alternating relation and connected by corner scores, each of said end walls having a flap foldably attached thereto along an upper horizontal score line, characterized in that:

each flap comprises a plurality of flap sections including a first flap section foldably attached to its end wall along said horizontal score line and additional flap sections successively attached to one another along fold lines parallel to said horizontal score line, and the flaps are foldable to form interior beams extending between the side walls and having upper faces constituting load-supporting ledges, the flap sections being foldable into parallel relation, and each first flap section being in juxtaposed relation with the inner face of its end wall.

5. The invention as defined in claim 4 wherein each of said first flap sections is substantially wider than any of said additional flap sections, whereby said ledges are spaced substantially below said horizontal score lines.

6. The invention as defined in claim 5 wherein each of said side walls has a flap foldably attached thereto along an upper horizontal score line, the side wall flaps being foldable inwardly of the carton to be disposed parallel to the side walls and having formed therein upwardly directed shoulders supportingly underlying end portions of the beams.

7. The invention as defined in claim 6 wherein each of said end walls has formed therein a hand opening immediately below the beam, whereby the user's lifting force is applied directly to the beam and the load supported thereon.

8. The invention as defined in claim 4 wherein each of said side walls has a flap foldably attached thereto along an upper horizontal score line, the side wall flaps being foldable inwardly of the carton to be disposed parallel to the side walls and having formed therein upwardly directed shoulders supportingly underlying end portions of the beams.

* * * * *